US011230080B2

(12) United States Patent
Cho et al.

(10) Patent No.: US 11,230,080 B2
(45) Date of Patent: Jan. 25, 2022

(54) MINI HOT PRESS APPARATUS

(71) Applicant: University of Ulsan Foundation for Industry Cooperation, Nam-gu (KR)

(72) Inventors: Sung-Lae Cho, Haeundae-gu (KR); Hae Woong Kwon, Nam-gu (KR); Van Quang Nguyen, Nam-gu (KR); Eun Ji Park, Nam-gu (KR); Eun Jung Park, Nam-gu (KR); Mal Sik Kim, Pohang-si (KR)

(73) Assignee: University of Ulsan Foundation for Industry Cooperation, Ulsan (KR)

( * ) Notice: Subject to any disclaimer, the term of this patent is extended or adjusted under 35 U.S.C. 154(b) by 494 days.

(21) Appl. No.: 15/759,230

(22) PCT Filed: Sep. 9, 2016

(86) PCT No.: PCT/KR2016/010155
§ 371 (c)(1),
(2) Date: Mar. 12, 2018

(87) PCT Pub. No.: WO2017/043910
PCT Pub. Date: Mar. 16, 2017

(65) Prior Publication Data

US 2018/0250905 A1 Sep. 6, 2018

(30) Foreign Application Priority Data

Sep. 11, 2015 (KR) ..... 10-2015-0128968

(51) Int. Cl.
*B30B 15/34* (2006.01)
*B30B 15/12* (2006.01)
(Continued)

(52) U.S. Cl.
CPC ..... *B30B 15/34* (2013.01); *B30B 11/02* (2013.01); *B30B 11/04* (2013.01); *B30B 15/02* (2013.01); *B30B 15/12* (2013.01); *B30B 15/022* (2013.01)

(58) Field of Classification Search
CPC ..... B30B 15/34; B30B 11/02; B30B 15/022
See application file for complete search history.

(56) References Cited

U.S. PATENT DOCUMENTS 2,990,602 A * 7/1961 Brandmayr ..... C04B 33/32 264/125
3,732,056 A * 5/1973 Eddy ..... B30B 11/02 425/352

(Continued)

FOREIGN PATENT DOCUMENTS

JP 61-199002 * 9/1986
JP 61-199002 A * 9/1986

(Continued)

OTHER PUBLICATIONS

International Search Report dated Dec. 8, 2016 From the Korean Intellectual Property Office Re. Application No. PCT/KE2016/010155 and Its Translation Into English. (4 Pages).

*Primary Examiner* — Xiao S Zhao
*Assistant Examiner* — Nicholas J Chidiac

(57) ABSTRACT

The present invention relates to a mini hot press apparatus, and more particularly, to an apparatus which can be used for making or annealing a polycrystalline material by pressurization and heating in various surrounding environments such as in a low vacuum, high vacuum, ultrahigh vacuum, high pressure gas, gas flow, even in air, etc.

5 Claims, 5 Drawing Sheets

(51) Int. Cl.

| | |
|---|---|
| ***B30B 11/02*** | (2006.01) |
| ***B30B 15/02*** | (2006.01) |
| ***B30B 11/04*** | (2006.01) |

(56) References Cited

U.S. PATENT DOCUMENTS

| | | | | |
|---|---|---|---|---|
| 3,797,986 | A * | 3/1974 | Onder | B30B 11/007 425/352 |
| 5,461,928 | A * | 10/1995 | Azzolini | B30B 15/068 100/258 R |
| 6,024,704 | A * | 2/2000 | Meador | A61B 5/0215 600/486 |
| 9,771,305 | B2 * | 9/2017 | Adachi | B30B 11/027 |
| 2006/0025002 | A1 * | 2/2006 | Zhang | H01J 37/20 439/329 |
| 2008/0145466 | A1 * | 6/2008 | Beane | B30B 15/0011 425/149 |
| 2014/0318711 | A1 * | 10/2014 | Wada | H01L 21/67092 156/378 |
| 2014/0367251 | A1 * | 12/2014 | Adachi | B30B 11/027 204/298.12 |
| 2017/0368780 | A1 * | 12/2017 | Middlemiss | B33Y 80/00 |

FOREIGN PATENT DOCUMENTS

| | | | |
|---|---|---|---|
| JP | 07-083959 | B2 * | 9/1995 |
| JP | 08-039300 | | 2/1996 |
| JP | 2646732 | | 8/1997 |
| JP | 2646732 | B2 * | 8/1997 |
| KR | 10-2002-0096490 | | 12/2002 |
| WO | WO 2017/043910 | | 3/2017 |

* cited by examiner

【Fig. 1】
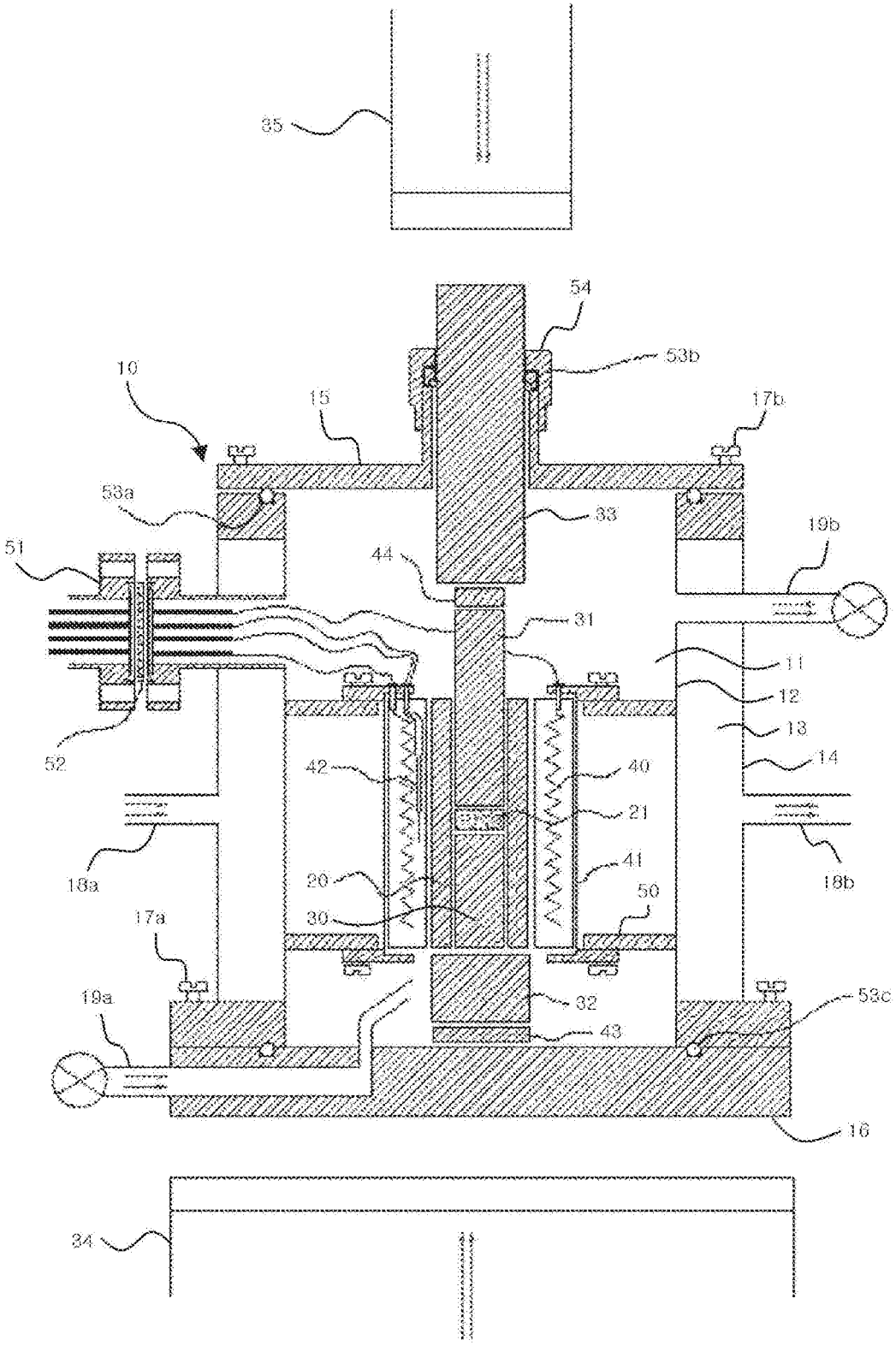

【Fig. 2】
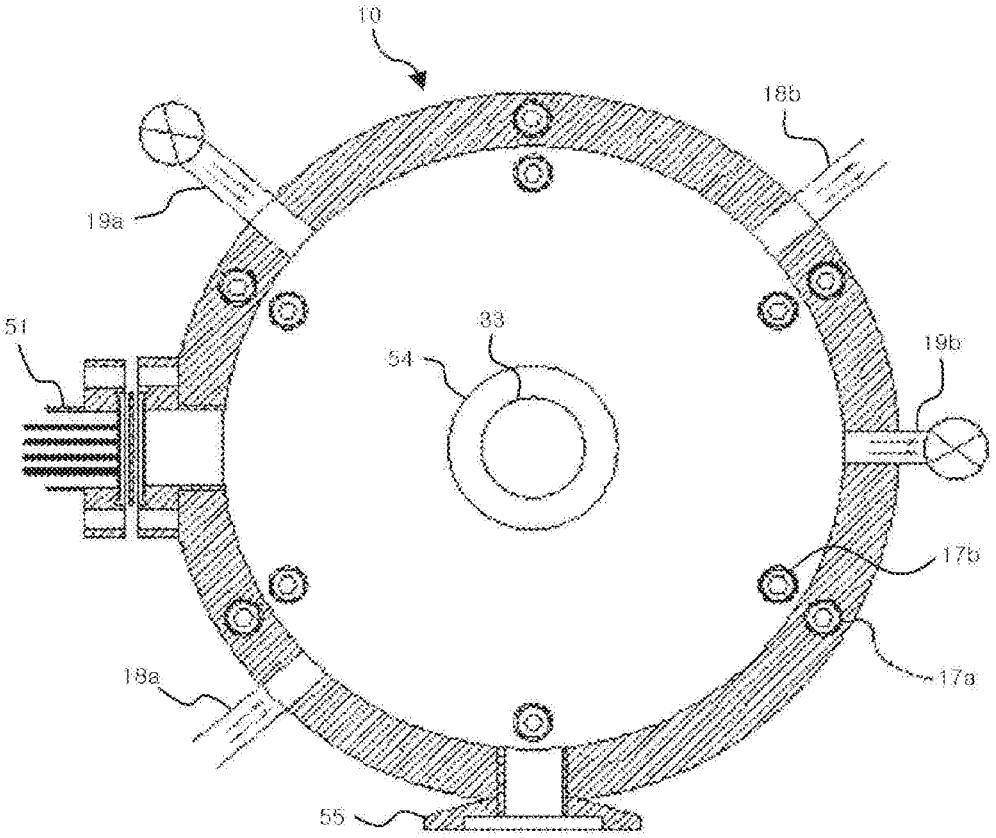

【Fig. 3】
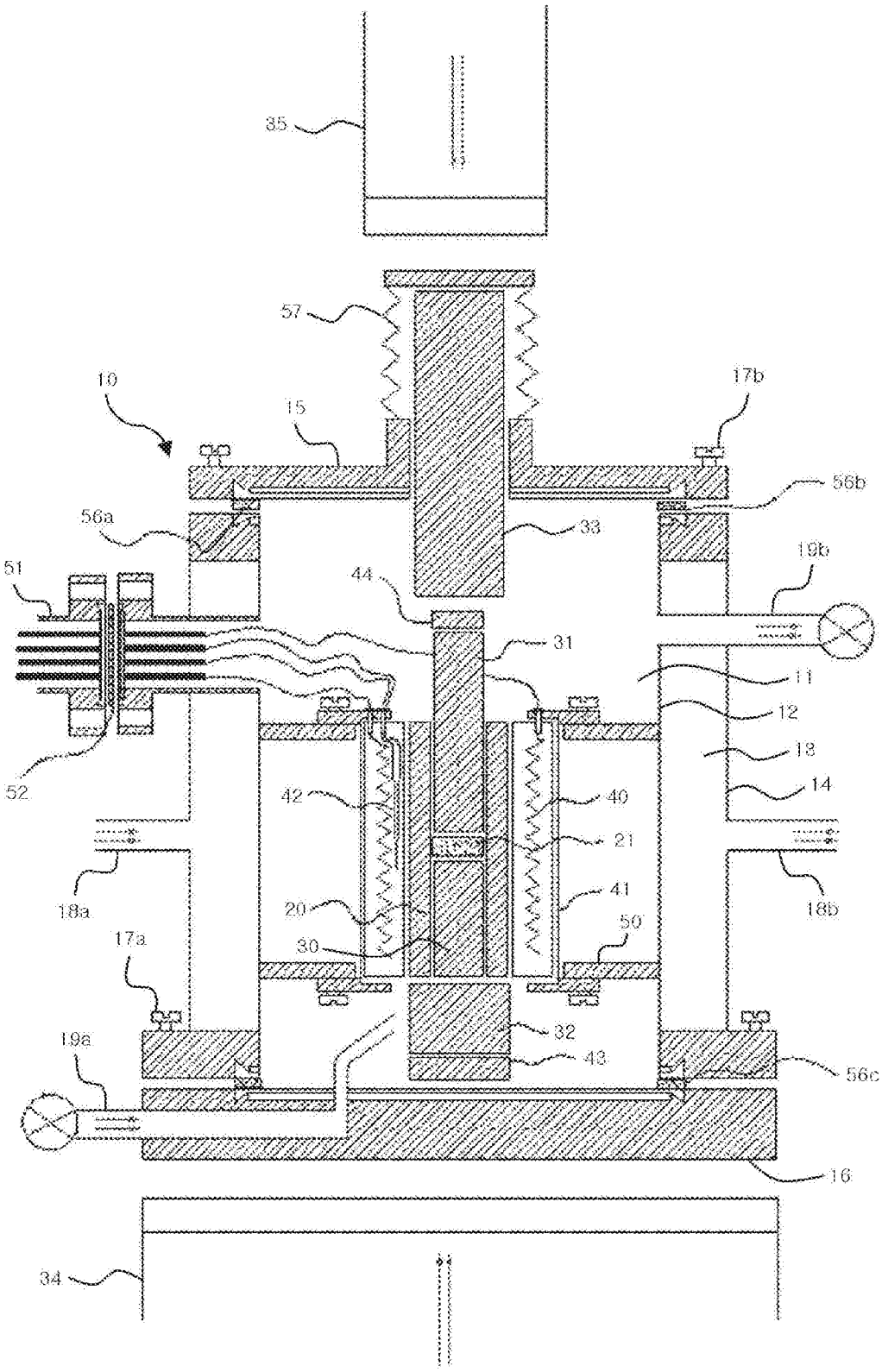

【Fig. 4】
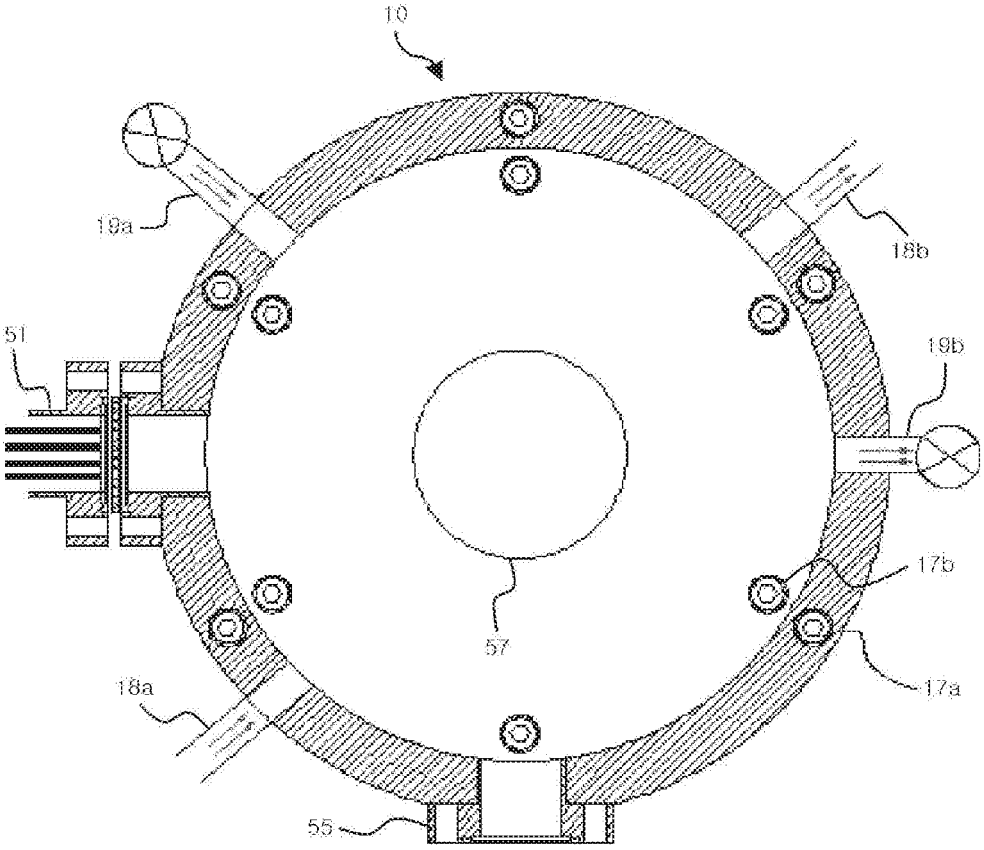

【Fig. 5】
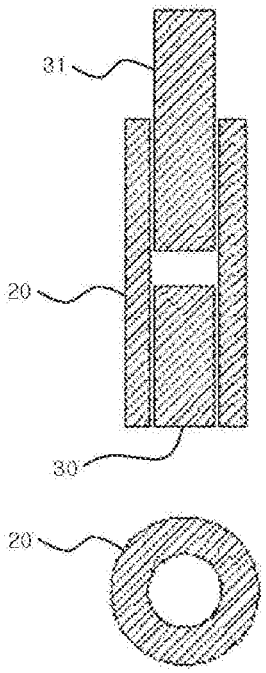

MINI HOT PRESS APPARATUS

RELATED APPLICATIONS

This application is a National Phase of PCT Patent Application No. PCT/KR2016/010155 having International filing date of Sep. 9, 2016, which claims the benefit of priority of Korean Patent Application No. 10-2015-0128968, filed on Sep. 11, 2015. The contents of the above applications are all incorporated by reference as if fully set forth herein in their entirety.

FIELD AND BACKGROUND OF THE INVENTION

The present invention relates to a mini hot press apparatus (compact hot press), and more particularly, to a mini hot press apparatus usable for making or annealing a polycrystalline material by pressurization and heating in various surrounding environments such as in low vacuum, high vacuum, ultrahigh vacuum, high pressure gas, gas flow, even in air, etc.

Generally, the term "hot press" simply refers to pressing in a hot state, and refers to a method or apparatus for molding a product by pressing at a predetermined temperature. Such a hot press is used for a process in which press-molding in a hot state is necessary, such as a process of making a printed circuit board (PCB), a fiber board, high grade construction materials (flooring, firebrick), a steel sheet for a vehicle, or the like, and in addition to the above-described application fields, use in special industrial fields such as a display (LCD, PDP) industry and flexible printed circuit board molding has been increasing.

A conventional hot press apparatus generally has a large size and has no other function besides press-molding.

SUMMARY OF THE INVENTION

The present invention provides a mini hot press apparatus having a compact size and various functions.

The present invention provides a mini hot press apparatus including a chamber including an inner case, a first space formed inside the inner case, an outer case having a size larger than the inner case and connected to the inner case to be sealed, a second space configured to accommodate a cooling medium as a sealed space formed between the inner case and the outer case, a cap installed on an upper end of each of the inner case and the outer case, and a bottom plate installed on a lower end of each of the inner case and the outer case; a hollow mold installed in the first space of the chamber to accommodate a material therein; a first rod inserted into the hollow mold and located under the material; a second rod inserted into the hollow mold and located on the material; a third rod located under the first rod in the first space of the chamber; a fourth rod located on the second rod and installed to pass through the cap of the chamber to be disposed over the first space and the outside of the chamber; a heater installed in the first space of the chamber to surround the hollow mold; and a press installed at the outside of the chamber and configured to press the fourth rod.

In the present invention, the heater may be a cylinder heater having a hollow cylindrical shape.

The mini hot press apparatus according to the present invention may further include a thermal radiation blocking material installed on an outer circumference of the heater.

The mini hot press apparatus according to the present invention may further include a thermocouple installed between the hollow mold and the heater.

The mini hot press apparatus according to the present invention may further include low thermal conductive plates each installed between the second rod and the fourth rod, and under the third rod.

The mini hot press apparatus according to the present invention may further include a cooling medium inlet and a cooling medium outlet installed to be connected to the second space of the chamber.

The mini hot press apparatus according to the present invention may further include a gas inlet and a gas outlet installed to be connected to the first space of the chamber.

In the present invention, a gas may be at least one of an inert gas, a high-pressure gas, and a cooling medium.

In the present invention, a vacuum pump may be connected to the chamber to form a vacuum in the chamber.

In the present invention, the hollow mold, the third rod, and the fourth rod may be formed of an insulator such as alumina, and thus electrical resistance of the material may be measurable during pressing and when a current is applied to the first rod and the second rod, the material may be capable of self-heating.

The mini hot press apparatus according to the present invention may further include a quick-disconnect coupling installed on a portion of the cap through which the fourth rod passes; and O rings each installed between the inner case, the outer case, and the bottom plate, between the inner case, the outer case, and the cap, and between the cap and the quick-disconnect coupling.

The mini hot press apparatus according to the present invention may further include an ultrahigh vacuum bellows (UHV bellows) installed on a portion of the cap through which the fourth rod passes; and copper gaskets each installed between the inner case, the outer case, and the bottom plate, and between the inner case, the outer case, and the cap.

An apparatus according to the present invention has a compact size and various functions.

BRIEF DESCRIPTION OF THE SEVERAL VIEWS OF THE DRAWINGS

FIG. 1 is a cross-sectional view illustrating an overall configuration of a mini hot press apparatus usable for a high vacuum or high-pressure gas according to one embodiment of the present invention.

FIG. 2 is a plan view of FIG. 1.

FIG. 3 is a cross-sectional view illustrating an overall configuration of a mini hot press apparatus usable for an ultrahigh vacuum according to another embodiment of the present invention.

FIG. 4 is a plan view of FIG. 3.

FIG. 5 is a cross-sectional view of a mold used in the present invention.

DESCRIPTION OF SPECIFIC EMBODIMENTS OF THE INVENTION

Hereinafter, embodiments of the present invention will be described in detail with reference to the accompanying drawings.

FIG. 1 is a cross-sectional view illustrating an overall configuration of a mini hot press apparatus usable for a high vacuum or high-pressure gas according to one embodiment of the present invention, FIG. 2 is a plan view of FIG. 1, FIG. 3 is a cross-sectional view illustrating an overall configuration of a mini hot press apparatus usable for an ultrahigh vacuum according to another embodiment of the present invention, FIG. 4 is a plan view of FIG. 3, and FIG. 5 is a cross-sectional view of a mold used in the present invention.

A mini hot press apparatus according to the present invention may include a chamber 10, a first space 11, an inner case 12, a second space 13, an outer case 14, a cap 15, a bottom plate 16, coupling members 17*a* and 17*b*, a cooling medium inlet 18*a*, a cooling medium outlet 18*b*, a gas inlet 19*a*, a gas outlet 19*b*, a hollow mold 20, a material 21, a first rod 30, a second rod 31, a third rod 32, a fourth rod 33, a first press 34, a second press 35, a heater 40, a thermal radiation blocking material 41, a thermocouple 42, a first low thermal conductive plate 43, a second low thermal conductive plate 44, a supporter 50, a multi pin electrical feedthrough 51, copper gaskets 52, 56*a*, 56*b*, and 56*c*, O rings 53*a*, 53*b*, and 53*c*, a quick-disconnect coupling 54, a vacuum pump 55, an ultrahigh vacuum bellows 57, etc.

The size of the mini hot press apparatus according to the present invention may be equal to or smaller than 1 m, preferably from 0.05 to 0.8 m, and more preferably from 0.1 to 0.6 m in each of a widthwise direction, a lengthwise direction, and a vertical direction.

The chamber 10 may include the first space 11, the inner case 12, the second space 13, the outer case 14, the cap 15, the bottom plate 16, the coupling members 17*a* and 17*b*, the cooling medium inlet 18*a*, the cooling medium outlet 18*b*, the gas inlet 19*a*, the gas outlet 19*b*, etc.

The first space 11 is an internal space of the inner case 12 formed inside the inner case 12, and may be sealed by the cap 15 and the bottom plate 16.

The inner case 12 may be configured in, for example, a cylindrical shape. An upper portion and a lower portion of the inner case 12 may be open, and may be respectively sealed by the cap 15 and the bottom plate 16.

The second space 13 is a sealed space formed between the inner case 12 and the outer case 14, and may accommodate a cooling medium.

The outer case 14 has a greater size (diameter) than the inner case 12 and may be connected to the inner case 12 to be sealed. The outer case 14 may be configured in, for example, a cylindrical shape.

The cap 15 may be detachably installed on an upper end of each of the inner case 12 and the outer case 14.

The bottom plate 16 may be detachably installed on a lower end of each of the inner case 12 and the outer case 14.

The coupling members 17*a* and 17*b* serve to couple the inner case 12, the outer case 14, and the bottom plate 16 and to couple the inner case 12, the outer case 14, and the cap 15, and a thread coupling member or the like, for example may be used as the coupling member.

The cooling medium inlet 18*a* and the cooling medium outlet 18*b* are installed to be connected to the second space 13 of the chamber 10, and accordingly, the cooling medium may be introduced into and discharged from the chamber 10. A temperature of the chamber 10 may be easily controlled and the chamber 10 may be easily cooled by the cooling medium. Considering residence time, cooling efficiency, and the like of the cooling medium, the cooling medium inlet 18*a* is preferably installed in a lower portion of the chamber 10, and the cooling medium outlet 18*b* is preferably installed in an upper portion of the chamber 10. As the cooling medium, for example, water, liquid nitrogen, or the like may be used.

The gas inlet 19*a* and the gas outlet 19*b* are installed to be connected to the first space 11 of the chamber 10, and accordingly, a gas may be introduced into and discharged from the chamber 10. Considering residence time and the like of the gas, the gas inlet 19*a* is preferably installed in the lower portion of the chamber 10, and the gas outlet 19*b* is preferably installed in the upper portion of the chamber 10. A valve configured to open and close a gas flow may be installed on each of the gas inlet 19*a* and the gas outlet 19*b*.

As the gas, for example, an inert gas, a high-pressure gas, a cooling medium, or the like may be used. The inert gas may be used to prevent oxidation of the material 21, which is easily oxidized. The high-pressure gas may be used to raise an evaporation temperature of the material 21, which is easily evaporated at high temperature. The high-pressure gas may be, for example, a gas of 2 to 100 bar at room temperature, and may preferably be a gas of 10 to 100 bar. The cooling medium may be used to directly cool the material 21. The cooling medium may be supplied in a high-pressure gas state.

Meanwhile, the vacuum pump 55 may be connected to the chamber 10 to form a vacuum in the first space 11 of the chamber 10. A degree of vacuum may be appropriately selected from the group consisting of a low vacuum (1 to 1000 mbar), a medium vacuum ($10^{-3}$ to 1 mbar), a high vacuum ($10^{-7}$ to $10^{-3}$ mbar), an ultrahigh vacuum ($10^{-10}$ to $10^{-7}$ mbar), and an extremely high vacuum (less than $10^{-10}$ mbar).

As described above, according to a need of a user, the inside of the chamber 10 may be formed with various atmospheres such as an inert gas atmosphere, a high-pressure gas atmosphere, a cooling atmosphere, a vacuum atmosphere, and the like.

The hollow mold 20 may be installed in the first space 11 of the chamber 10 to accommodate the material 21, which will be molded therein. The mold 20 may be made of stainless steel, ceramic, metal, graphite, or the like which is resistant to pressure. As shown in FIG. 5, the mold 20 may be, preferably, a cylindrical hollow body. An inner wall of the mold 20 may be coated with a graphite film layer, and accordingly, a chemical reaction or interaction between the mold 20 and the material 21 may be prevented and the material 21 may be easily taken out from the mold 20. The mold 20 may be disposed inside the cylinder heater 40 to be coaxial with the heater 40 for uniform heating.

A powder material may be used as the material 21 when the material 21 is molded into a polycrystalline material. The powder material 21 may be located between the first rod 30 and the second rod 31 in the mold 20.

The first rod 30 may be inserted into the hollow mold 20 and located under the material 21. An upper end of the first rod 30 may be coated with the graphite film layer, and accordingly, a chemical reaction or interaction between the first rod 30 and the material 21 may be prevented.

The second rod 31 may be inserted into the hollow mold 20 and located on the material 21. A lower end of the second rod 31 may be coated with the graphite film layer, and accordingly, a chemical reaction or interaction between the second rod 31 and the material 21 may be prevented.

The third rod 32 may be located under the first rod 30 in the first space 11 of the chamber 10. The third rod 32 may be integrally formed with the first rod 30.

The fourth rod 33 may be located on the second rod 31 and installed to pass through the cap 15 of the chamber 10 to be disposed over the first space 11 of the chamber 10 and the outside of the chamber 10.

The first press 34 and the second press 35 may be installed at the outside of the chamber 10, and may press the fourth rod 33 and/or the bottom plate 16 of the chamber 10. The first press 34 and the second press 35 may be hydraulic presses.

The heater 40 may be installed in the first space 11 of the chamber 10 to surround the hollow mold 20. The heater 40 may be used to heat the material 21. The heater 40 may be easily taken out through an upper portion of the chamber 10, and may not be pressed with the material 21. The heater 40 may be, preferably, a cylinder heater having a hollow cylindrical shape. Since the heater 40 is configured into the cylinder heater, heating efficiency can be improved by uniformly and quickly heating the hollow mold 20, the material 21, etc. A heating method of the heater 40 may be an induced electromotive force heating method (an RF heating method) or a direct heating method. The heater 40 may be connected to a proportional integral derivative (PID) temperature controller, and the temperature of the heater 40 may be easily and accurately controlled by the PID temperature controller.

Since the hollow mold 20, the third rod 32, and the fourth rod 33 are formed of an insulator such as alumina, electrical resistance of the material during pressing may be measured in real time. The electrical resistance may be measured using a resistance meter connected to the material via an electric wire, cable and/or connector. Further, when a current is applied to the first rod 30 and the second rod 31, the material may be capable of self-heating, and thus a separate heater may not be used.

The thermal radiation blocking material 41 is installed on an outer circumference of the heater 40 to serve to block thermal radiation outward from the heater 40. The thermal radiation blocking material 41 may be composed of a metal or ceramic material such as tantalum, nichrome, inconel, alumina, silicon carbide, silicon nitride, aluminum nitride, boron nitride, tungsten carbide, beryllium oxide, barium titanate, zirconia, ferrite, etc.

The thermocouple 42 may be installed between the hollow mold 20 and the heater 40 to measure a temperature of the material 21 in real time.

The first low thermal conductive plate 43 and the second low thermal conductive plate 44 are respectively installed under the third rod 32 and between the second rod 31 and the fourth rod 33 to serve to prevent heat transfer outward from the hollow mold 20. The first low thermal conductive plate 43 and the second low thermal conductive plate 44 may be composed of a material having low thermal conductivity, such as the above-described ceramic material (alumina or the like), plastic (polyimide or the like), etc. Thermal conductivity of each of the first low thermal conductive plate 43 and the second low thermal conductive plate 44 may independently be, for example, 0.1 to 100 W/m·K, preferably 0.1 to 50 W/m·K, more preferably 0.1 to 30 W/m·K, much more preferably 0.1 to 10 W/m·K, and most preferably 0.1 to 5 W/m·K. The thermal conductivity may be measured using a thermal conductivity meter at room temperature.

The supporter 50 is installed in the first space 11 of the chamber 10 to serve to support the heater 40, etc.

The multi pin electrical feedthrough 51 is installed at the outside of the chamber 10, and connected to the heater 40 and the thermocouple 42 through a wire to connect the heater 40 and the thermocouple 42 to the outside of the chamber 10. The copper gasket 52 may be installed at the multi pin electrical feedthrough 51 for sealing.

The vacuum pump 55 may be connected to the chamber 10 through a separate path shown in FIGS. 2 and 4. In the path, the rubber O rings may be used in the high vacuum, and the copper gaskets may be used in the ultrahigh vacuum.

Since the embodiment in FIGS. 1 and 2 is suitable for the high vacuum or the high-pressure gas, the O rings 53*a*, 53*b*, and 53*c*, and the quick-disconnect coupling 54 may be installed to maintain the high vacuum in the chamber 10.

The O rings 53*a*, 53*b*, and 53*c* may each be installed between the inner case 12, the outer case 14, and the bottom plate 16, between the inner case 12, the outer case 14 and the cap 15, and between the cap 15 and the quick-disconnect coupling 54 to seal each coupling portion. The rubber O rings may be used as the O rings 53*a*, 53*b*, and 53*c*.

The quick-disconnect coupling 54 may be installed on a portion of the cap 15 through which the fourth rod 33 passes, and may be rapidly connected and disconnected.

Since the embodiment in FIGS. 3 and 4 is suitable for the ultrahigh vacuum, the copper gaskets 56*a*, 56*b*, and 56*c* and the ultrahigh vacuum bellows 57 may be installed to maintain the ultrahigh vacuum in the chamber 10 instead of installing the O rings 53*a*, 53*b*, and 53*c*, and the quick-disconnect coupling 54 in FIGS. 1 and 2.

The copper gaskets (Conflat flanges) 56*a*, 56*b*, and 56*c* may each be installed between the inner case 12, the outer case 14, and the bottom plate 16, and between the inner case 12, the outer case 14, and the cap 15 to seal each coupling portion to a high degree.

The ultrahigh vacuum bellows 57 may be installed on a portion of the cap 15 through which the fourth rod 33 passes to seal the coupling portion to a high degree.

The apparatus of the present invention is a multifunctional apparatus and has various functions. The apparatus of the present invention may be used to make the polycrystalline material from the powder, and may be used as a furnace for an annealing purpose. The apparatus of the present invention may be operated with the low vacuum, the high vacuum, or the ultrahigh vacuum, may include the high-pressure gas or the gas flow, or may be operated even in air. In the present invention, the cylinder heater and water-cooling may be used to control an operation temperature, and the thermal radiation blocking material and the low thermal conductive plate may be used at particular locations to prevent heat from flowing outward from the apparatus. An ambient environment may be the low vacuum, the high vacuum, the ultrahigh vacuum, the high-pressure gas, the gas flow, air, or the like according to a usage of the apparatus.

When a polycrystalline material is made using a hot press method, a powder is added in the cylinder mold 20. The mold 20 is disposed inside the cylinder heater 40 to be coaxial with the heater 40. The heater 40 may be covered by the thermal radiation blocking material 41 to prevent thermal radiation outward from the heater 40. Further, heat transfer outward from the mold 20 may be prevented using two low thermal conductive plates 43 and 44 made of a low thermal conductive material. After forming the vacuum (the low vacuum, high vacuum, or the ultrahigh vacuum) in the chamber 10, loading the inert gas in the chamber 10 to prevent oxidation of the material or adding the high-pressure gas in the chamber 10 to raise an evaporation temperature of the material, the mold 20 and the material 21 are heated at an appropriate temperature using the heater 40 and the PID temperature controller. The temperature of the material 21 may be measured using the thermocouple 42. Hereinafter, the material 21 may be pressed at an appropriate pressure using the hydraulic presses 34 and 35.

When annealing the material, the mold 20, the first rod 30, the second rod 31, and the fourth rod 33 are taken out, and only the third rod 32 located at a lower level may be used as a supporter of the material 21. The material 21 may be annealed in a vacuum or a gas atmosphere having various pressures.

When the valve of each of the gas inlet 19*a* and the gas outlet 19*b* is closed and the vacuum pump 55 is connected to the chamber 10, the vacuum may be formed. When the vacuum pump 55 is closed and the gas is supplied to the chamber 10, a gas flow atmosphere or a high-pressure gas atmosphere may be formed. The rubber O rings 53*a*, 53*b*, and 53*c* and the quick-disconnect coupling 54 may be used for the high vacuum, and the copper gaskets (Conflat flanges) 56*a*, 56*b*, and 56*c* may be used for the ultrahigh vacuum. A gas flow beam may be used to cool the material 21. Although the rubber O rings and the copper gaskets may be used in the low vacuum, the high-pressure gas, or the gas flow, the rubber O rings are recommended to be used in this case because the rubber O rings may be reused after opening the chamber.

REFERENCE NUMERALS

10: chamber
11: first space
12: inner case
13: second space
14: outer case
15: cap
16: bottom plate
17*a*, 17*b*: coupling members
18*a*: cooling medium inlet
18*b*: cooling medium outlet
19*a*: gas inlet
19*b*: gas outlet
20: hollow mold
21: material
30: first rod
31: second rod
32: third rod
33: fourth rod
34: first press
35: second press
40: heater
41: thermal radiation blocking material
42: thermocouple
43: first low thermal conductive plate
44: second low thermal conductive plate
50: supporter
51: multi pin electrical feedthrough
52: copper gasket
53*a*, 53*b*, 53*c*: O rings
54: quick-disconnect coupling
55: vacuum pump
56*a*, 56*b*, 56*c*: copper gaskets
57: ultrahigh vacuum bellows

The invention claimed is:

1. A mini hot press apparatus comprising:

a chamber including an inner case, a first space formed inside the inner case, an outer case having a size larger than the inner case and connected to the inner case to be sealed, a second space configured to accommodate a cooling medium as a sealed space formed between the inner case and the outer case, a cap installed on an upper end of each of the inner case and the outer case, and a bottom plate installed on a lower end of each of the inner case and the outer case;

a hollow mold installed in the first space of the chamber to accommodate a material therein;

a first rod inserted into the hollow mold and located under the material;

a second rod inserted into the hollow mold and located on the material;

a third rod located under the first rod in the first space of the chamber;

a fourth rod located on the second rod and installed to pass through the cap of the chamber to be disposed over the first space and the outside of the chamber;

a heater installed in the first space of the chamber to surround the hollow mold;

a first press installed at the outside of the chamber and configured to press the bottom plate, and a second press installed at the outside of the chamber and configured to press the fourth rod, a thermocouple installed between the hollow mold and the heater;

a first low thermal conductive plate installed between the third rod and the bottom plate, and a second low thermal conductive plate installed between the second rod and the fourth rod;

a gas inlet and a gas outlet installed to be connected to the first space of the chamber wherein the hollow mold, the third rod, and the fourth rod are formed of an insulator;

a quick-disconnect coupling installed on a portion of the cap through which the fourth rod passes;

O rings each installed between the inner case, the outer case, and the bottom plate, between the inner case, the outer case, and the cap, and between the cap and the quick-disconnect coupling; and a multi pin electrical feedthrough installed at the outside of the chamber, and connected to the heater and the thermocouple through a wire; and a copper gasket installed at the multi pin electrical feedthrough for sealing, wherein the heater is a cylinder heater having a hollow cylindrical shape, wherein the thermocouple measures a temperature of the material, wherein thermal conductivity of each of the first low thermal conductive plate and the second low thermal conductive plate is independently 0.1 to 100 W/m·K, wherein an inner wall of the mold is coated with a graphite film layer, wherein an upper end of the first rod is coated with the graphite film layer, and wherein a lower end of the second rod is coated with the graphite film layer.

2. The mini hot press apparatus of claim 1, further comprising a thermal radiation blocking material installed on an outer circumference of the heater.

3. The mini hot press apparatus of claim 1, further comprising a cooling medium inlet and a cooling medium outlet installed to be connected to the second space of the chamber.

4. The mini hot press apparatus of claim 1, wherein a gas is at least one of an inert gas, a high-pressure gas, and a cooling medium.

5. The mini hot press apparatus of claim 1, wherein a vacuum pump is connected to the chamber to form a vacuum in the chamber.

* * * * *